US006364360B1

(12) United States Patent
Kaufman

(10) Patent No.: US 6,364,360 B1
(45) Date of Patent: Apr. 2, 2002

(54) FOAM BOOK WITH BENDABLE MEMORY RETAINING ELEMENTS

(76) Inventor: Shari Kaufman, 317 Greens Farms Rd., Westport, CT (US) 06880

( * ) Notice: Subject to any disclaimer, the term of this patent is extended or adjusted under 35 U.S.C. 154(b) by 0 days.

(21) Appl. No.: 09/538,418

(22) Filed: Mar. 29, 2000

(51) Int. Cl.[7] ..... B42D 1/00

(52) U.S. Cl. ..... 281/15.1; 281/29; 281/38; 402/4; 434/317; 434/433; 446/147; D19/26

(58) Field of Search ..... 281/15.1, 31, 36, 281/37, 28, 51; 402/70, 73, 80 R, 4, 317; 434/365, 406, 433; 446/147; D19/26, 29

(56) References Cited

U.S. PATENT DOCUMENTS

| | | | | |
|---|---|---|---|---|
| 4,120,100 A | * | 10/1978 | Dugan | 35/73 |
| 4,176,473 A | | 12/1979 | Rae | |
| 4,280,241 A | | 7/1981 | Pfaff | |
| 4,650,216 A | * | 3/1987 | Carlson | 281/34 |
| 4,673,608 A | | 6/1987 | Cline | |
| 4,702,700 A | | 10/1987 | Taylor | |
| 4,756,556 A | | 7/1988 | Ader et al. | |
| 4,853,994 A | | 8/1989 | Ekstein | |
| 4,909,542 A | * | 3/1990 | Marks | 281/15.1 |
| 5,049,078 A | | 9/1991 | Thomsen | |
| 5,096,204 A | | 3/1992 | Lippman | |
| 5,213,507 A | | 5/1993 | Ozrovitz | |
| 5,503,102 A | | 4/1996 | McDonnell | |
| 5,525,088 A | | 6/1996 | Mayne | |
| 5,683,112 A | * | 11/1997 | McQueeny | 281/29 |
| 5,713,743 A | | 2/1998 | Clements | |
| 5,746,637 A | | 5/1998 | Hunt | |
| 5,758,777 A | | 6/1998 | Dods | |
| 5,765,245 A | * | 6/1998 | Breto | 5/640 |
| 5,799,980 A | * | 9/1998 | McAdam | 281/29 |
| 5,800,238 A | | 9/1998 | Cowley et al. | |
| 5,803,743 A | | 9/1998 | Kaufman | |
| 5,833,509 A | | 11/1998 | Hunt | |
| 5,871,237 A | | 2/1999 | Hunt | |
| 5,895,305 A | | 4/1999 | Cowley et al. | |
| 5,901,983 A | | 5/1999 | Bini | |
| 5,915,729 A | | 6/1999 | Vap | |
| 6,070,909 A | * | 6/2000 | Kaufman | 281/37 |
| 6,131,952 A | * | 10/2000 | Blau et al. | 281/33 |
| 6,189,932 B1 | * | 2/2001 | Kaufman | 281/37 |

FOREIGN PATENT DOCUMENTS

| | | |
|---|---|---|
| GB | 2130085 A | 5/1984 |

* cited by examiner

*Primary Examiner*—Willmon Fridie, Jr.
*Assistant Examiner*—Monica Carter
(74) *Attorney, Agent, or Firm*—Hedman & Costigan, P.C.

(57) ABSTRACT

A book constructed of foam is improved wherein a bendable, shape retaining material is used to enhance the user's enjoyment of the disclosed foam book.

19 Claims, 7 Drawing Sheets

FOAM BOOK WITH BENDABLE MEMORY RETAINING ELEMENTS

The present invention relates to a book which is useful as a children's book. More particularly, the present invention is related to a book which is constructed at least partially of foam. Most particularly, the present book is related to a book which has pop-out elements or manipulatives, each having the characteristics of being bendable with shape retaining elements. The books of the present invention are suitable, for example, as a bath time book, a puzzle book or as a standard reading book.

BACKGROUND OF THE PRESENT INVENTION

A variety of books are currently on the market which are constructed for use by small children. The types of books generally are soft and comprise only a few pages.

Pfaff, U.S. Pat. No. 4,280,241 discloses a book with just a few pages which is made by inserting the foam elements into pockets of a plastic or cloth material. Similarly, Marks, U.S. Pat. No. 4,909,542 discloses a book in which a layer of a soft material is contained within a covering material. Neither Pfaff '241 nor Marks '542 teach or suggest including in the foam a shape retaining element.

Additionally, neither Pfaff '241 nor Marks '542 are suitable for manufacture solely by die-cutting the pages. Both require the additional step of inserting the foam elements in a plastic or cloth material. Thus, they are further unsuitable for providing figures or other elements which are removable from the page. Due to the plastic or cloth covering, cutting through the covering to cut out the foam elements would necessarily leave holes in the covering which render the book subject to tearing and otherwise make the book unattractive.

Mention is also made of Hunt, U.S. Pat. No. 5,833,509 which teaches the inclusion of a bendable figurine attached to the outside of the book, but not die cut from the book pages.

Also, of interest is McDonnell, U.S. Pat. No. 5,503,102 which teaches a shape retaining book mark which is constructed of paper strips having an elongated, deformable metal or wire strand sandwiched between the paper strips.

Special mention is also made of concurrently pending U.S. patent application Ser. No. 09/149,781 which teaches a book constructed solely of foam but does not suggest the inclusion of a shape retaining insert which would provide figures or elements having a shape retaining element.

Accordingly, it would represent an advancement in the art of providing books for use by young children if a book was provided in which had shape retaining bendable pages or alternatively, which had removable foam figures or other similar elements which could be bent and retain their shape. In this manner, the child would be able to play with the book or popout elements from the book more realistically thereby adding to the child's enjoyment of the book.

SUMMARY OF THE PRESENT INVENTION

It is an object of the present invention to provide a book which is suitable as a bath book.

It is another object of the present invention to provide a book which is washable.

It is a further object of the present invention to provide a book which may be constructed via a die-cut process.

It is still another object of the present invention to provide a book which is adaptable to have puzzle pieces or other shapes die cut therein.

It is a still further object of the present invention to provide a book in which each puzzle piece or shape die cut therein is able to float on water.

It is another further object of the present invention to provide a book which is constructed of a soft material.

It is still another further object of the present invention to provide a book in which at least a portion of the book includes a shape retaining element, wherein either or both one or more pages from the book, or a popout portion of the book, contains a bendable material having the characteristics of a shape retaining element.

Accordingly, these objects and others are achieved by the book of the present invention which comprises a front cover; a back cover; at least one page between the front and back covers; and a means for binding the front cover, back cover and at least one page; wherein at least a portion of one of the front cover, the back cover and at least one page are constructed of a material comprising a foam material, wherein at least a portion of the foam is provided with a shape retaining element which are suitable for use with or related to a theme of the book.

DETAILED DESCRIPTION OF THE PRESENT INVENTION AND DESCRIPTION OF THE PREFERRED EMBODIMENTS

The following description of preferred embodiments is presented to illustrate the present invention and is not to be construed to limit the claims in any manner whatsoever.

Figure 1:
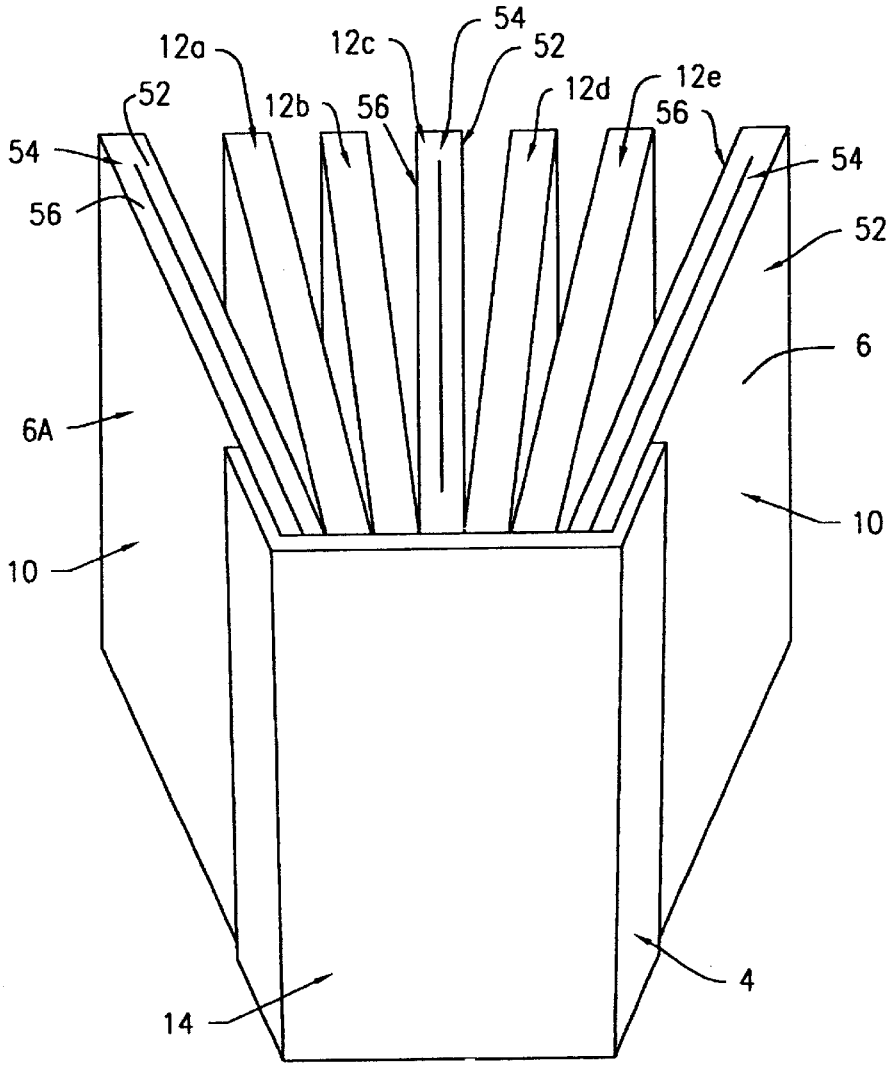
FIG. 1 depicts an offset view of a preferred embodiment of a book of the present invention in the open position.

The present invention provides an improved foam book which includes a shape retaining element. Referring to FIG. 1, a preferred embodiment of a book 4 of the present invention is shown which comprises a front cover 6, a back cover 6A, and five pages 12*a*, 12*b*, 12*c*, 12*d* and 12*e* being bound along one side by a binding means 14 to form the book. Preferably the binding of the front cover 6, back cover 6A and pages 12*a* through 12*e* to the binding means 14 is effected with a suitable adhesive such as those known to persons of ordinarily skilled in the art. An exemplary suitable adhesive system would comprise a combination of heat melt and glue adhesion methodology. Alternatively, other suitable binding means 14 may be employed, such as, for example, ring binding, male/female mating type bindings, spiral bindings, stitching, and slide on type clip bindings.

In the embodiment of FIG. 1, the front cover 6, page 12*c*, and back cover 6A comprise a three layer construction of a top layer 52 and a bottom layer 56, each comprised of foam, and a middle layer 54 comprised of a shape retaining material, wherein the top 52 and bottom 56 layers are adhered together to sandwich the middle layer 54 therebetween. This three layered construction is also shown in cross-sectional view FIG. 1A. FIG. 1B shows the three layer construction in a bent position.

Top and bottom layers, 52 and 56 respectively, are preferably comprised of a foam, typically the same foam from which the rest of the book is constructed, such as a polymeric ethyl vinyl acetate (EVA), either the high density type or the low density type. EVA is a preferred material of construction because it has been found that this material not only yields a product which is impervious to the degrading effects of water exposure, but is durable enough to withstand the rambunctious play of young children, all while being flexible, relatively soft in texture and "cuddly" in nature, as well as washable. A further advantage of EVA is that when wet it will adhere to the surface or sides of a bath tub or shower area and will float in water. Of course, other types of foams may be employed in the practice of the present invention. Also in other preferred embodiments, the cover(s) 6 and 6A and page(s) 12*a* through 12*e* may be screen printed or colored or otherwise treated with coatings as desired. Especially preferred are embodiments in which the printing on the cover(s) 6 and 6A and page(s) 12*a* through 12*e* have a related theme, such as that of a story and the like.

The shape retaining material as middle layer 54 may comprise any known form of deformable metal, wire or other material known to those skilled in the art which can be bent with relative ease but has sufficient shape retaining strength to prevent the foam from returning to its original shape without the exertion of any external forces. For example, a thin strip, plate or webbing of metal having a thickness of about 1/64 to 1/16 of an inch may be employed, preferably about 1/32 of an inch. Likewise one or more metal wires having a diameter of about 1/64 to 1/16 of an inch, preferably about 1/32 of an inch may be employed.

The top and bottom layers 52 and 56 respectively, are adhered together around the middle layer 54 preferably by any adhesive method known to those of ordinarily skilled in the art, such as heat melt and glue adhesion methodology. In this manner the bendable shape retaining elements 54 of the present invention are provided in the book 4.

With specific reference to the binding means 14, as shown in FIG. 1, the binding is shown as a perfect binding in which the binding 14 extends and is connected to a portion of the top cover 6 and the bottom cover 6A, and also to the rear edges of the covers and pages along its inner surface.

While the entire book 4 of the present invention may be formed by die cutting the foam and foam containing bendable shape retaining inserts, and binding means 14 and assembling the pieces according to the above description to form a book 4 with bendable shape retaining portions, other embodiments, may also be practiced within the scope of the present invention. By way of example, one may form or cut the covers 6 and 6A, as well as any page(s) 12*a* through 12*e* into any desired size(s) or shape(s), such animals, cartoon characters, people, numbers, symbols, figurines, structures, places, dolls, works of art, etc. Where only the covers are shaped, the interior page(s) may be shortened so that they do not extend outside of the cover if desired.

Moreover FIG. 1 represents a view of the book 4 in an open position without any applicable differences in page thickness being drawn to scale. It is contemplated that the nature of the present invention provides for a book which exhibits the proper size, page thickness, tactility, softness, flexibility and durable construction to be repeatedly opened and played with, including the repeated removal of any popout components 2 and including the repeated bending of any components including the shape retaining element 54, by children.

Figure 2:
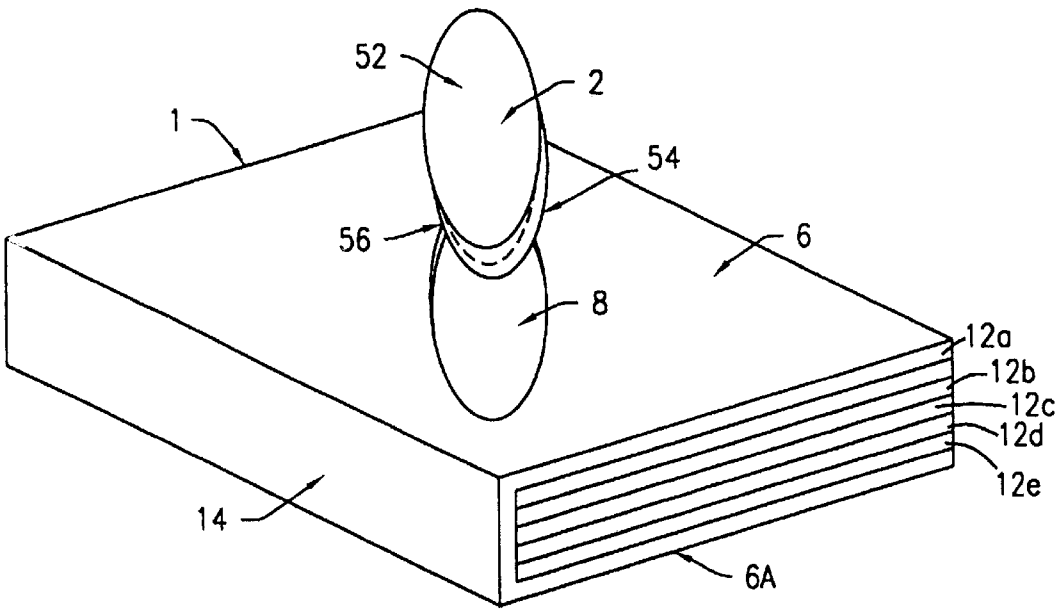
FIG. 2 depicts an offset top view of another preferred embodiment of a book of the present invention in the closed position.

Turning to FIG. 2, depicting a side view of another embodiment of the present invention in the closed position, shows the front and back covers 6 and 6A as well as a plurality of interior pages 12*a* through 12*e*. Although it is contemplated that the respective thicknesses of the front cover 6, interior pages 12*a* through 12*e* and the back cover 6A might be approximately equal, in other embodiments of the present invention each of the aforementioned components may be of different thicknesses, such as in order to provide the page with a popout or other function.

Figure 3:
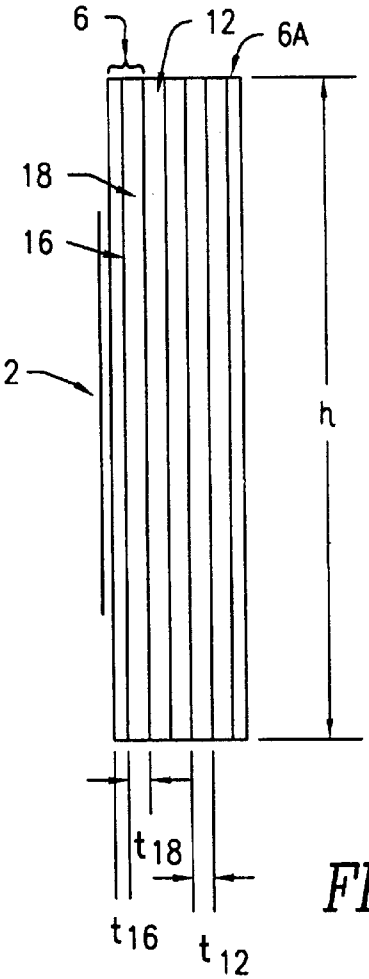
FIG. 3 depicts a side view of a preferred embodiment of the present invention wherein the book is in a closed position.

In an embodiment including a popout component 2, the page(s) 12*a* through 12*e* or cover(s) 6 and 6A from which the popout 2 is provided may independently be constructed of a foam or any other material suitable for construction of book such as paper or cardboard. These components may also be die-cut so as to form the desired shape of the popout component 2, thereby leaving an analogously shaped hole 8 (FIG. 2) in the page(s) 12*a* through 12*e* and/or cover(s) 6 and 6A. Referring to FIGS. 2 and 3, in a preferred embodiment where the front cover is constructed of foam, the popout component 2 is cut from hole 8 of holed wall portion 16 in the front cover such that the popout component 2 is provided with a backing wall portion 18. In an alternative embodiment, wherein the page desired to contain the popout 2 is constructed of a nonbendable material such as cardboard, the popout 2 is manufactured of a foam and shape retaining element as herein described to the dimensions of the cut out hole made in the page for containing the popout 2. Such cooperation between the popout component 2 and the analogous hole 8 or recess in the page or cover of the book may, in preferred embodiments, fit together in a puzzle-like fashion. Regardless of the particular embodiments of the components and popout of the book, the preferred embodiment of the present invention contemplates use of a bendable shape retaining element comprised of a foam, which when wet, will stick to bathroom surfaces such as bath tubs, shower walls, and the like and will float in water.

When properly adhered by melting and/or glue adhesion, provision of backing wall portion 18 on holed wall portion 16 provides a way for popout portion 2 to be placed in the analogously shaped hole 8 of holed wall portion 16 without being pushed completely through from one side of holed walled portion 16 through the other. Accordingly, when providing for backing wall 18, the total thickness $t_{12}$ of a given page(s) 12*a* through 12*e* or cover(s) 6 and 6A may be adjusted to reflect the combined thickness $t_{16}$ of holed wall portion 16 with the thickness $t_{18}$ of backing wall portion 18. Similarly, the thickness $t_{12}$ of the given page(s) 12*a* through 12*e* may vary depending upon whether a popout element 2 is included on the page 12*a* through 12*e*. Although not directly pictured, $t_{12}$ may of course, much like the example shown in front cover 6, have a combined thickness analogous to that pictured in $t_{16}$ and $t_{18}$.

Figure 4:
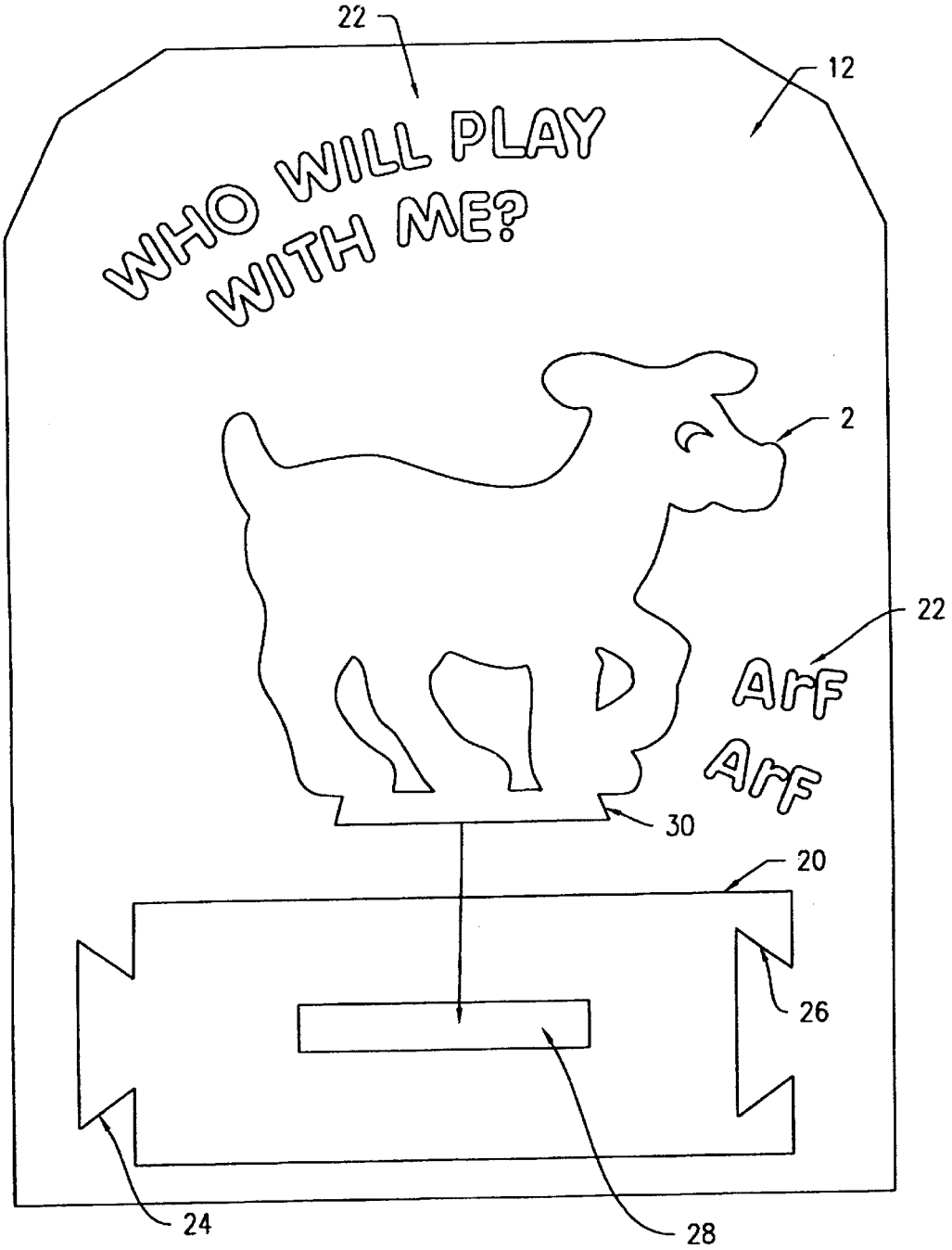
FIG. 4 depicts a front view of a book page or cover which is provided with puzzle pieces or shapes die cut therein as fitted into the page.

The popout component 2 may be of varying thicknesses, and also, may be puzzle piece shaped so as to fit together with other popouts which may be provided in the book in a puzzle like fashion outside of the book such as when stuck to a bath tub wall. See for example the popouts shown in FIG. 4. Referring to FIG. 4 an illustrative page 12 of a book of the present invention is shown wherein popout 2 has a dog shape and popout 20 is a stand for the dog shape popout 2. It can be appreciated that the insert 30 of dog shape popout 2 will fit into slot 28 of stand popout 20. Popout 20 is also provided with a dovetail 24 and mortise 26 such that it can form a puzzle piece for cooperation with other popouts contained in the book (not shown). Page 12 is also provided with silkscreen printing 22.

Figure 1A:
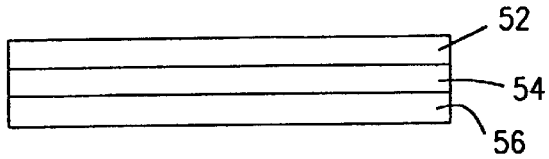
FIG. 1A depicts a cross-sectional end view of a page or cover of a book of the present invention.
Figure 1B:
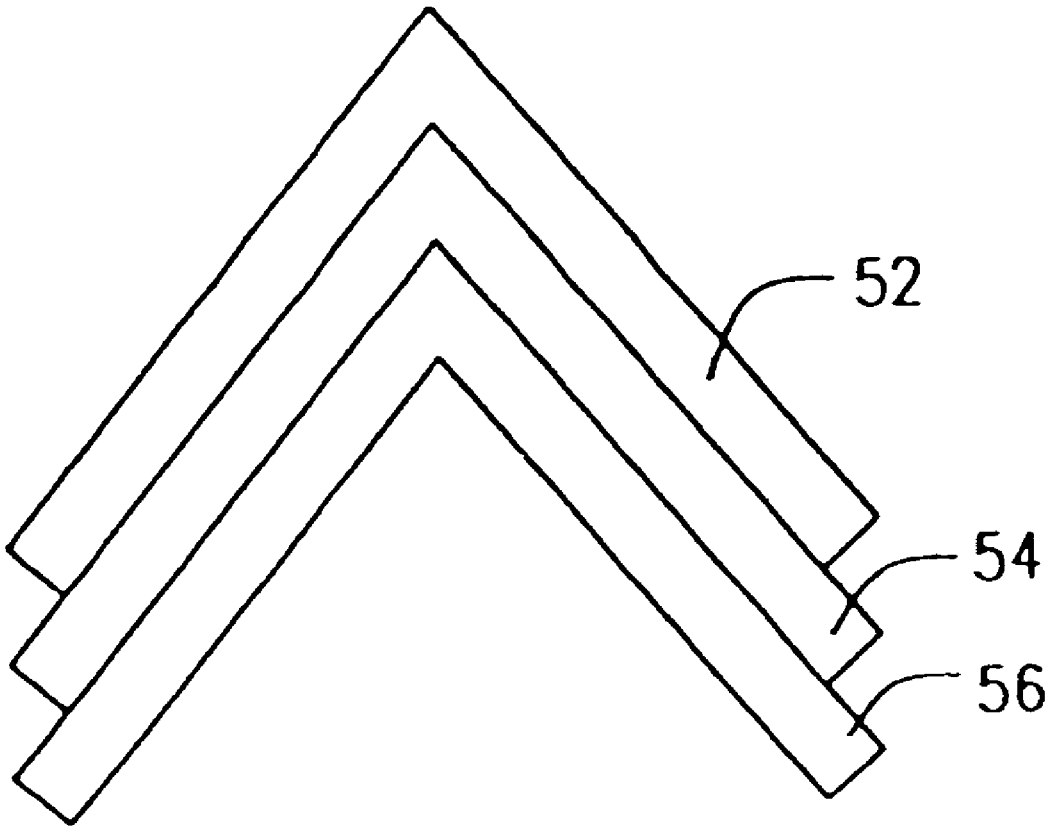
FIG. 1B depicts a page of the book of the present invention in the bent position.
Figure 2A:
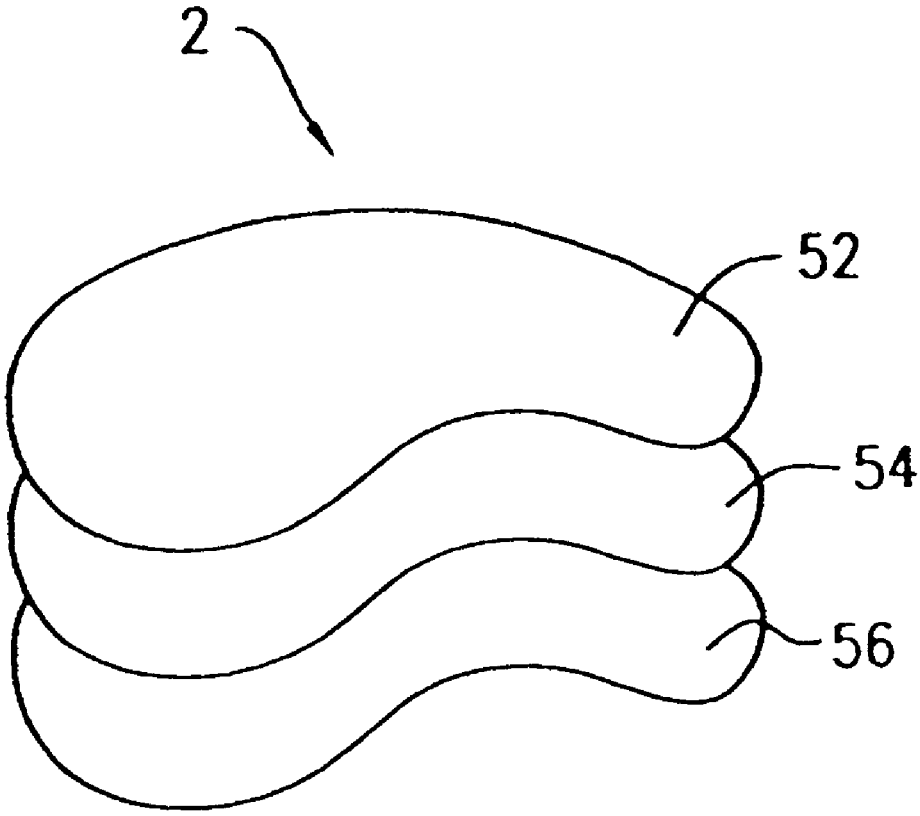
FIG. 2A depicts a popout from a page of the present invention in the bent position.

In a preferred embodiment of these types (FIGS. 2, 3 and/or 4), the popout component(s) 2 may contain the shape retaining element 54, such as shown in the three layered construction of FIG. 1A. In this manner the popout elements 2, when bent, will retain their bent shape in the absence of other bending forces. FIG. 2A depicts the popout component 2 in a bent position.

In other preferred embodiments it is possible to shape or die cut the actual pages 12*a* through 12*e* themselves, in such a way as to provide for pages 12*a* through 12*e* that fit into and can be removed from the binding means 14 in a puzzle-like fashion. In these embodiments the edges of pages 12*a* through 12*e* may be provided with dovetails and/or mortises or other interlocking means which cooperate with the mortises and/or dovetails or other interlocking means on the binding embodiment. In this type of embodiment, the pages themselves 12*a* through 12*e* can be formed to cooperate in a puzzle-like fashion as well. In preferred embodiments of this type, the page(s) 12*a* through 12*e* may contain the shape retaining element 54 (such as seen in FIG. 1), such that the pages 12*a* through 12*e*, when bent, will retain their bent shape in the absence of other bending forces.

Figure 5:
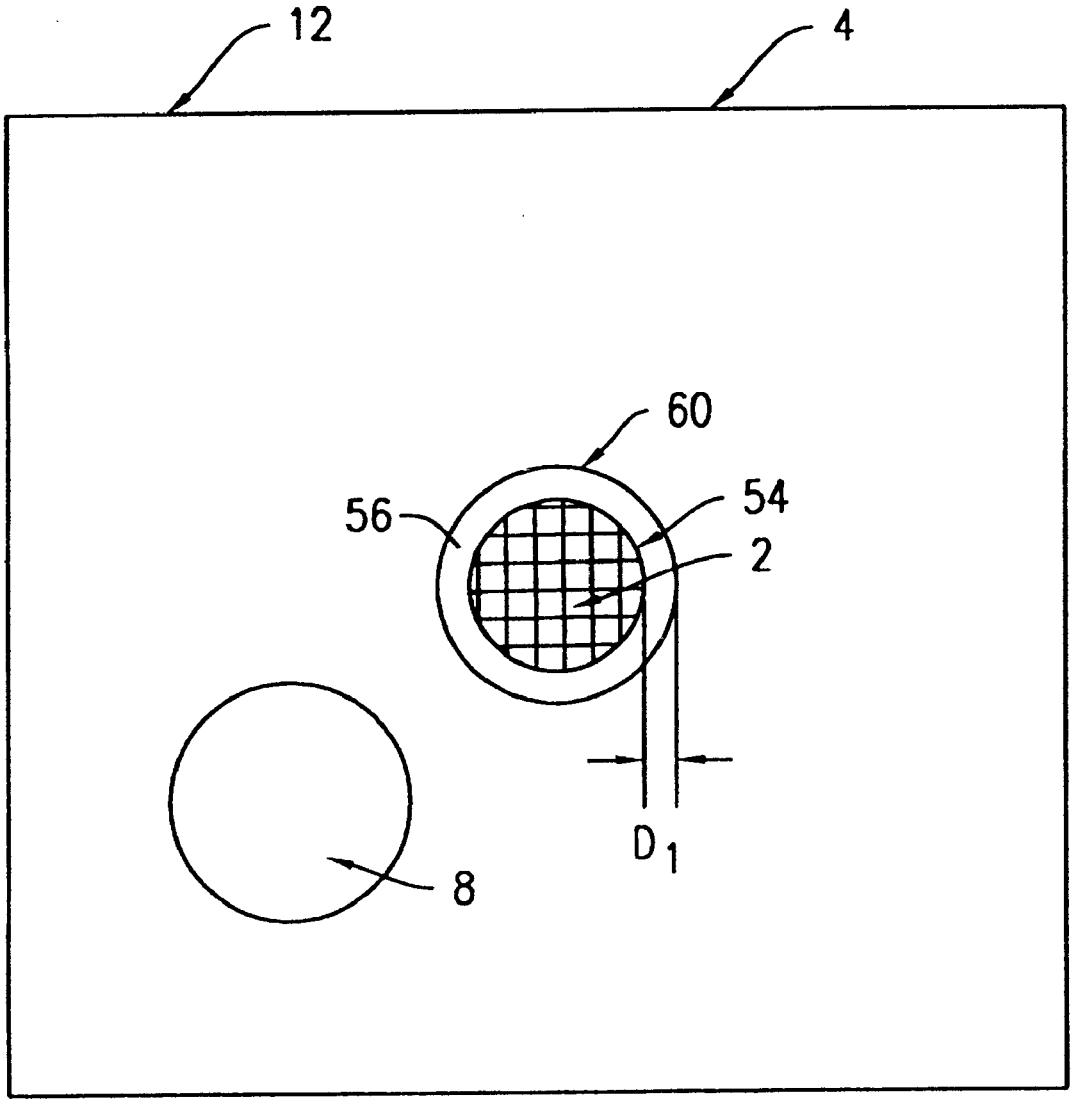
FIG. 5 depicts a front view of a book page or cover, comprising of a popout figure having a shape retaining material, which is shown in cross-section.

FIG. 5 represents a front view of an alternative embodiment of a page 12 in a book 4, of the present invention. As shown, the page 12 contains a popout element 2, which when die cut forms an analogously shaped hole 8 in the backing portion of the page, such as shown in FIGS. 2 and 3 above. Such popout element 2, in reference to FIG. 1A, comprises a shape retaining material as its middle layer 54. The shape retaining middle layer 54 is of the same general shape of the popout element 2, but smaller in scale relative to the popout element 2, such that when bent, the shape retaining middle layer 54 does not protrude from the periphery of the top layer 52 (not shown) and the bottom layer 56 of the popout element 2. It is preferred that the shape retaining middle layer 54, when manufactured, be a distance $D_1$ from the popout element's periphery 60, where $D_1$ is about ¼ inch. It is also preferred that the shape retaining middle layer 54 comprises any known deformable metal or other material having sufficient shape retaining strength to prevent the foam layers of the popout element from reverting to its unbent shape without the exertion of external forces.

Figure 6:
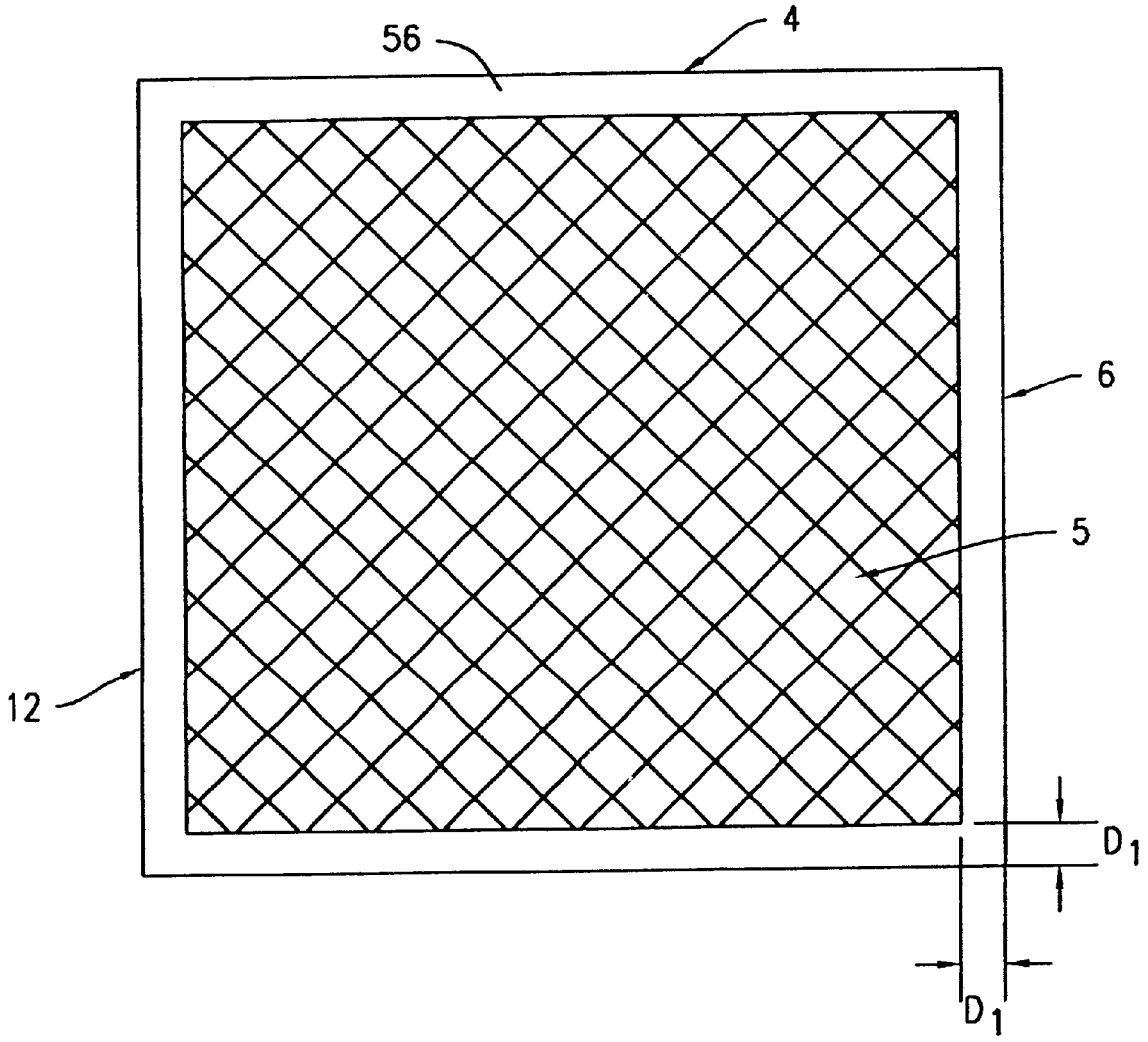
FIG. 6 depicts a cross-sectional front view of a book page or cover, wherein middle layer containing a shape retaining material is shown.

FIG. 6 represents a cross-sectional front view of an alternative embodiment of a page in a book 4, of the present invention. As shown, the page 12 has a three layer construction (see FIG. 1A) wherein a shape retaining material is provided as its middle layer 54. The shape retaining middle layer 54 is of the same general shape as the page 12, but smaller in scale relative to the respective periphery of the page 12. The scale of the shape retaining middle layer 54 is small enough that when bent, the shape retaining middle layer 54 does not protrude from the periphery of the outer layers, namely the top layer 52 (not shown) and the bottom layer 56. It is preferred that the shape retaining middle layer 54, when manufactured, be a distance $D_1$ from the periphery 62 of the page 12, where $D_1$ is preferably about ¼ inch. It is also preferred that the shape retaining middle layer 54 comprise any known deformable metal or other material having sufficient shape retaining strength to prevent the foam layers of the page from reverting to their unbent shape without the exertion of external forces.

All of the above referenced patents, patent applications and publications are hereby incorporated by reference. Many variations of the present invention will suggest themselves to those of ordinary skill in the art in light of the above detailed description. All such obvious modifications are within the full intended scope of the claims of the present application.

What is claimed is:

1. An improved book of the type comprising a front cover, a back cover, and at least one page being bound along one side by a binding means to form said book; and wherein the improvement comprises:

at least a portion of one of said front cover, back cover, or at least one page comprises a three layer construction of a top and bottom layer, each comprised of foam, and a middle layer comprised of a shape retaining material, wherein said layers are adhered together by an adhering means to sandwich said middle layer therebetween; and whereby said portion of said front cover, back cover or at least one page is bendable by a user of said book with the bent shape being retained.

2. A book as defined in claim 1 wherein said book comprises about five pages.

3. A book as defined in claim 1 wherein at least one of said front cover, back cover or at least one page are provided with writing or pictures.

4. A book as defined in claim 1 wherein said covers or at least one page of said book are die cut in a shape selected from the group consisting of animals, foods, plants, letters, numbers, symbols, figurines, sculptures, characters, structures, places and works of art.

5. A book as defined in claim 1, wherein at least one of said covers or at least one page of said book are comprised of foam and are further die cut to provide a popout component.

6. A book as defined in claim 5, wherein said popout component has a shape selected from the group consisting of animals, foods, plants, letters, numbers, symbols, figurines, sculptures, characters, structures, places and works of art.

7. A book as defined in claim 5, wherein said popout component comprises the shape retaining middle layer.

8. A book as defined in claim 7, wherein the shape retaining layer in the popout component has an area smaller than the periphery of the top and bottom layers of said popout element.

9. A book as defined in claim 1, wherein said shape retaining middle layer of said covers or at least one page has an area smaller than the periphery of said top and bottom layers of said covers or page or pages.

10. A book as defined in claim 1, wherein said shape retaining material when bent into a shape by a force external to said book, has sufficient strength to retain said shape absent additional external forces to said book.

11. A book as defined in claim 10, wherein said shape retaining material comprises a wire.

12. A book as defined in claim 11, wherein said wire has a diameter of about 1/64 to about 1/16 of an inch.

13. A book as defined in claim 12, wherein said wire has a diameter of about 1/32 of an inch.

14. A book as defined in claim 10, wherein said shape retaining material comprises a metal sheet.

15. A book as defined in claim 14, wherein said metal sheet has a thickness of from about 1/64 to about 1/16 of an inch.

16. A book as defined in claim 15, wherein said metal sheet has a thickness of about 1/32 of an inch.

17. A book as defined in claim 15, wherein said book has a plurality of said popout components.

18. A book as defined in claim 17, wherein said popout components are puzzle piece shaped.

19. A book defined in claim 1, wherein said front cover, back cover, and at least one page are constructed of a nonbendable material, and wherein at least one of said front cover, back cover and at least one page is die cut to provide a hole or recess for containing a popout figure, said popout being constructed of a top and bottom layer of foam and having a shape retaining element sandwiched between said top and bottom foam layers.

* * * * *